US010047487B2

(12) United States Patent
Kuo

(10) Patent No.: US 10,047,487 B2
(45) Date of Patent: Aug. 14, 2018

(54) STRUCTURAL IMPROVEMENT OF ASSEMBLED TRAFFIC CONE

(71) Applicant: JING NAN TRAFFIC ENGINEERING CO., LTD., Changhua County (TW)

(72) Inventor: Shu-Nan Kuo, Changhua County (TW)

(73) Assignee: Jing Nan Traffic Engineering Co., Ltd., Changhua (TW)

( * ) Notice: Subject to any disclaimer, the term of this patent is extended or adjusted under 35 U.S.C. 154(b) by 222 days.

(21) Appl. No.: 15/184,752

(22) Filed: Jun. 16, 2016

(65) Prior Publication Data

US 2017/0002528 A1 Jan. 5, 2017

(30) Foreign Application Priority Data

Jul. 3, 2015 (TW) ..... 104210842 U

(51) Int. Cl.
*E01F 9/654* (2016.01)
*E01F 9/688* (2016.01)

(52) U.S. Cl.
CPC ..... *E01F 9/654* (2016.02); *E01F 9/688* (2016.02)

(58) Field of Classification Search
CPC ..... E01F 9/654; E01F 9/688; E01F 9/692
USPC ..... 116/63 C
See application file for complete search history.

(56) References Cited

U.S. PATENT DOCUMENTS 3,147,734 A * 9/1964 Knapp ..... E01F 9/688 116/63 C
5,630,675 A * 5/1997 Boeger ..... E01F 9/692 116/63 C
5,755,528 A * 5/1998 Kulp et al. ..... E01F 9/688 116/63 P
2012/0234228 A1* 9/2012 Kuo ..... E01F 9/654 116/63 C
2015/0299967 A1* 10/2015 Maus et al. ..... E01F 9/654 116/63 C

FOREIGN PATENT DOCUMENTS

GB 992281 A * 5/1965 ..... E01F 9/688

* cited by examiner

*Primary Examiner* — R. A. Smith

(57) ABSTRACT

A structural improvement of assembled traffic cone is provided, in which a base and a cone member are separately manufactured then assembled afterward. The center of the base is formed with a combination hole allowing the cone member to be sleeved and assembled, the inner periphery of the combination hole is formed with a convex mounting ring; the foundation portion of the cone member is formed with a combination ring part which is concavely formed with an annular mounting slot allowing the convex mounting ring of the base to be mounted, a decoration mounting ring having a diameter slightly larger than the diameter of the combination hole of the base is formed at the top end of the annular mounting slot, so when the base and the cone member are assembled, the decoration mounting ring is served to cover the edge of the combination hole of the base.

4 Claims, 5 Drawing Sheets

STRUCTURAL IMPROVEMENT OF ASSEMBLED TRAFFIC CONE

BACKGROUND OF THE INVENTION

Field of the Invention

The present invention relates to a structural improvement of assembled traffic cone for solving the problems of mold fabricating expenditure and storage management of a conventional integrally-formed traffic cone, and with the design of separately manufacturing a cone member and a base then assembling afterward, the mold fabricating expenditure can be reduced, the cone members and the bases with different specifications can be manufactured in advance and stored for future use, so that the traffic cone with the required specifications listed in an order can be effectively assembled, therefore problems and disadvantages of additional cost for overtime working or delaying the delivery date because of the conventional fashion of manufacturing only after receiving orders can be solved, thus the present invention is provided with an excellent industrial application value.

Description of Related Art

In the manufacturing of a conventional traffic cone, the cone member and the base are integrally formed through an injection molding means, the manufacturing process is relatively easy but may be limited by the forming status of the cone member, for preventing the cone member from being damaged and having flaws, a secondary recycled or regenerated material cannot be adopted, and a primary material having better fluidity is required for the injection molding operation, therefore the whole material cost cannot be lowered; moreover, for satisfying the specification variation and the weight ratio difference, the cone member having different height requires the base having different specification, a considerable amount molds with different specifications have to be fabricated, so the high expenditure for fabricating molds is inevitable, which brings a serious impact on the industrial economic benefits.

For solving the expenditure relative to fabricating molds with multiple specifications, the applicant of the present invention has provided a design of manufacturing the cone member and the base through a multi-staged injection molding means, the base is firstly manufactured through a mold then is placed at a preset location where the mold for forming the cone member is installed, so when the cone member is formed through the injection molding means, the base is enabled to be partially embedded and combined with the cone member, thereby allowing the cone member and the base to be integrally assembled as one piece; because the base is separately manufactured, a low-cost secondary material or regenerated wastes can be adopted for the manufacturing, thereby effectively reducing the material cost, meanwhile in the fabrication of the manufacturing mold, only a few molds with respect to the specification of the cone member are required to be fabricated, so with the installation of the base and a preset amount of pads, a traffic cone with required specification can be manufactured, the expenditure for fabricating molds can be greatly reduced, and a better industrial economic benefit is provided.

However, in the above-mentioned traffic cone formed through the multi-staged injection molding means, the material cost and the expenditure for fabricating molds can be greatly reduced, but instead of manufacturing a large amount of traffic cones with different specifications in advantage and storing for future use, the traffic cone has to be manufactured according to the specifications listed in the customer's order, when the ordered amount is not a lot, the manufacturing may be able to meet the required quantity and the delivery date, but if the ordered quantity is a lot and the delivery date is urgent, the manufacturing may not catch up and overtime working is needed, so the whole production cost is increased, or even the delivery date would be delayed, possible penalty may be caused and the goodwill is affected. Such disadvantages shall be seriously concerned by the skilled people in the art.

Based on the disadvantages of the traffic cone formed through the multi-staged injection molding means, the applicant of the present invention has developed an assembled traffic cone, a cone member and a base of a traffic cone are separately manufactured, and with a convex and concave structure correspondingly formed on the cone member and the base, a stable mounting and assembling relation between the cone member and the base can be achieved, so the cone member and the base with various specifications can be manufactured in advance, when an order is received, the cone member and the base satisfying the specifications listed in the order can be selected for rapidly assembling and forming the required traffic cone, thereby solving the problems of overtime working and delaying delivery date.

However, according to the above-mentioned assembled traffic cone, only rapidness and stableness in assembly are considered, when the base is assembled with a combination part of the cone member, an obvious gap is formed between the base and the cone member, so not only the whole appearance and the product quality are significantly affected, a problem of being damaged or broken when an improper external force being applied would also happen, thus said shortages shall be improved.

SUMMARY OF THE INVENTION

In view of the conventional integrally-formed traffic cone and the traffic cone formed through the multi-staged injection molding means still having shortages of high expenditure for fabricating molds with various specifications and the manufacturing process not being flexible and the assembled traffic cone having disadvantages in the assembly stability and in the whole appearance, the applicant of the present invention has been researching and developing for improvements, with his experience and skills in the arts, a structural improvement of assembled traffic cone is provided by the present invention.

For solving the problems and disadvantages existed in the manufacturing of the conventional traffic cone, the present invention provides a novel design of separately manufacturing a cone member and a base of a traffic cone then assembling afterward, and a combination ring part allowing the base to be sleeved and mounted is formed at the bottom end of the cone member, and an annular mounting slot concavely formed on the combination ring part and a convex mounting ring formed on the base can provide a stably mounting and combing effect, a decoration mounting ring formed at the top end of the annular mounting slot can be served to cover the edge of a combination hole of the base, so that not only the assembling relation is stabilized, the whole appearance can also be well maintained.

According to the structural improvement of assembled traffic cone provided by the present invention, by separately manufacturing the base and the cone member, the material cost and the expenditure for fabricating mold can be effectively reduced, and a convenience in rapid assembly is also provided, and not only the assembling relation is stabilized, the whole appearance and the quality can also be well maintained.

DETAILED DESCRIPTION OF THE PREFERRED EMBODIMENT

One preferred embodiment of the present invention will be described with reference to the drawings.

Figure 1:
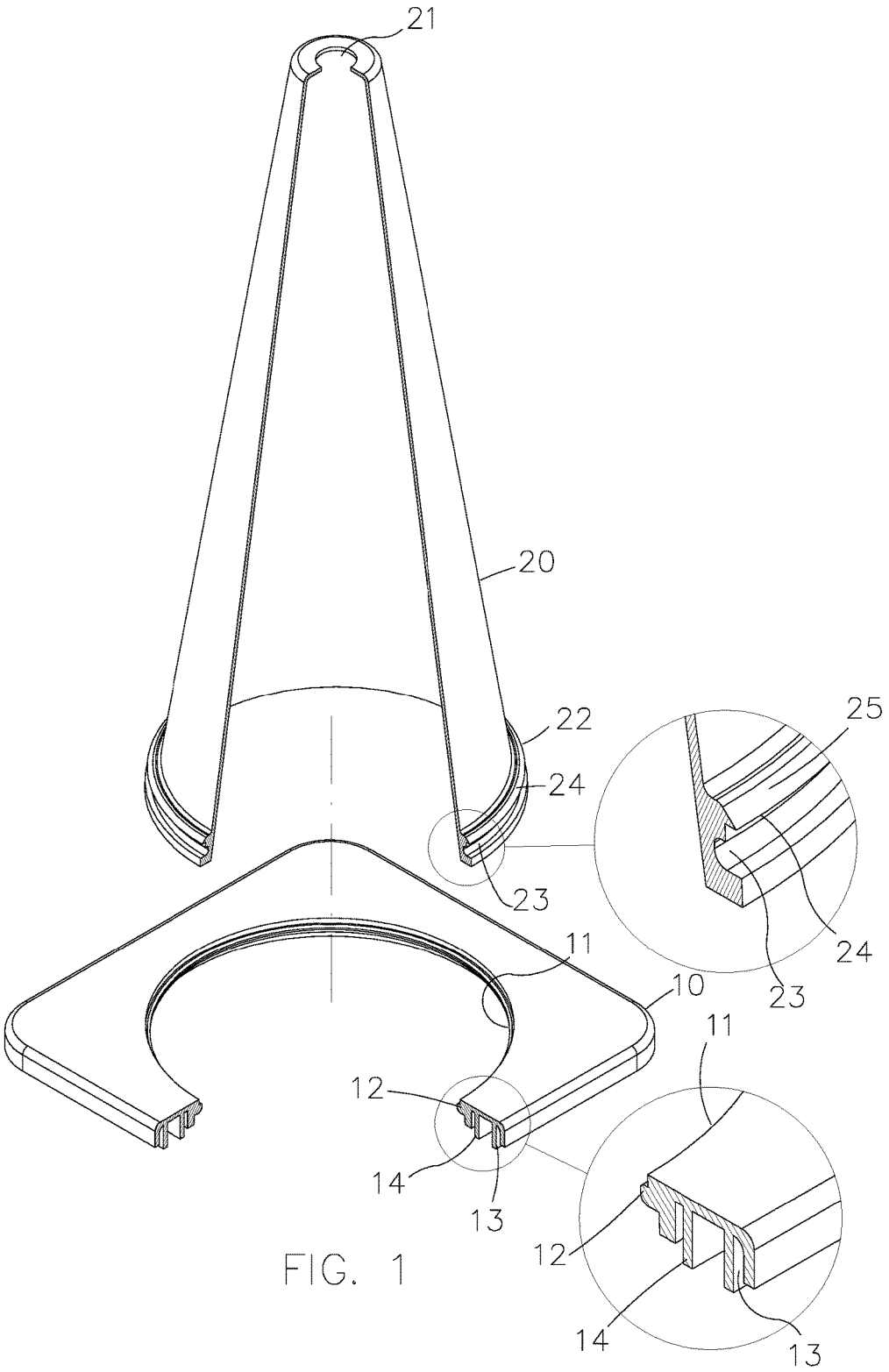
FIG. 1 is an exploded view showing the structure according to one preferred embodiment of the present invention.
Figure 2:
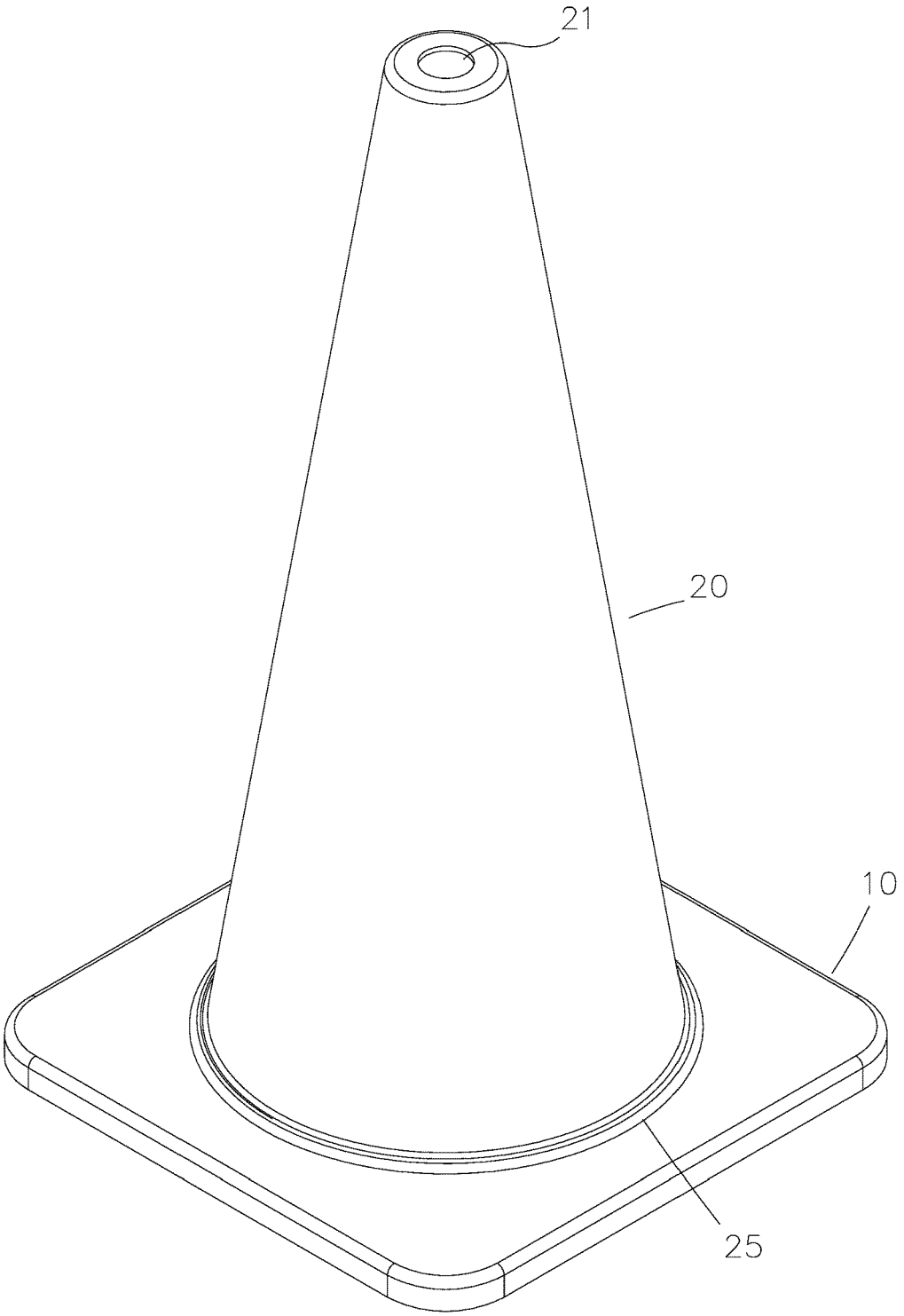
FIG. 2 is a schematic view showing the structure according to one preferred embodiment of the present invention.
Figure 3:
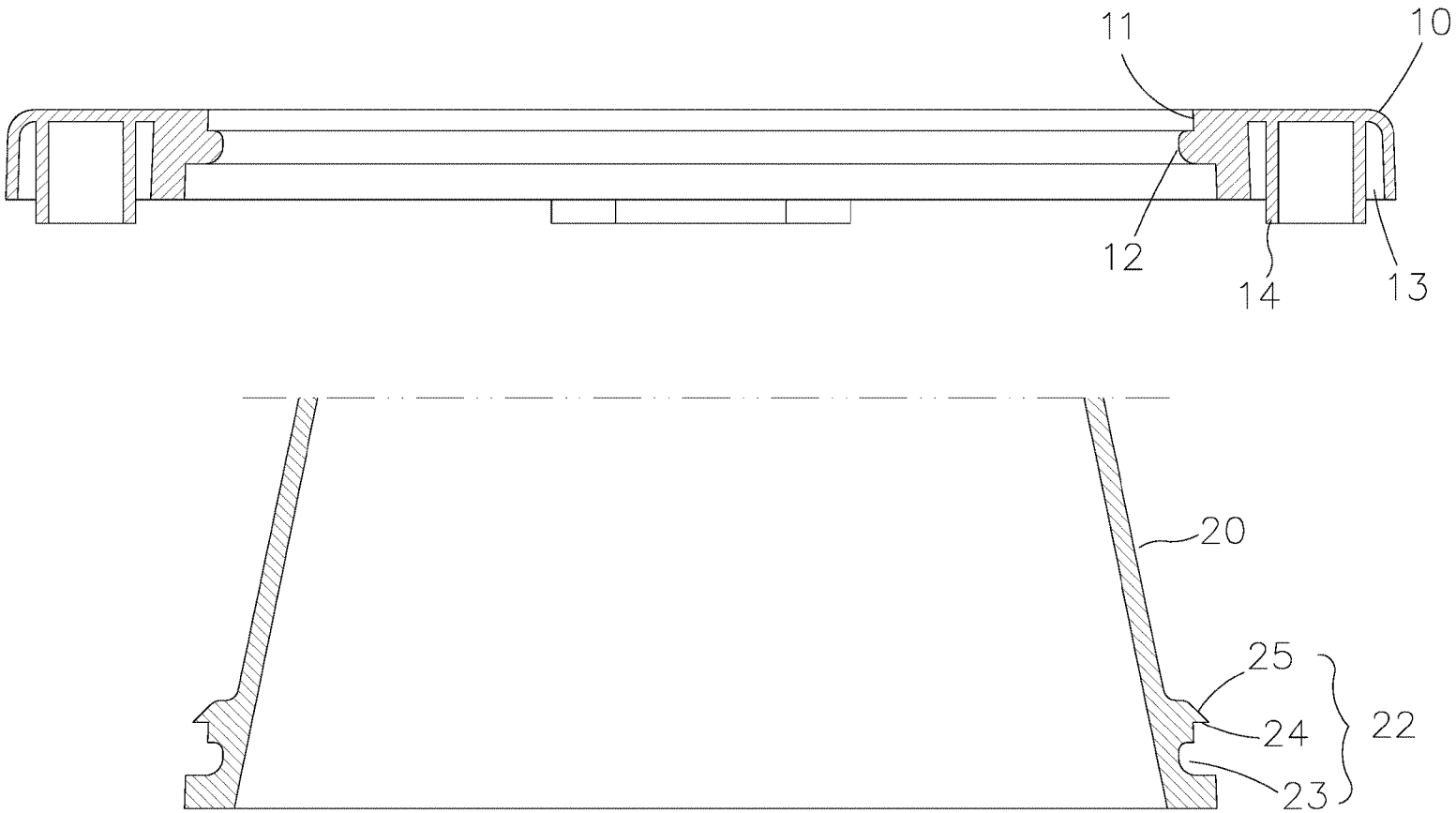
FIG. 3 is a planar exploded view showing a partial structure according to one preferred embodiment of the present invention.
Figure 4:
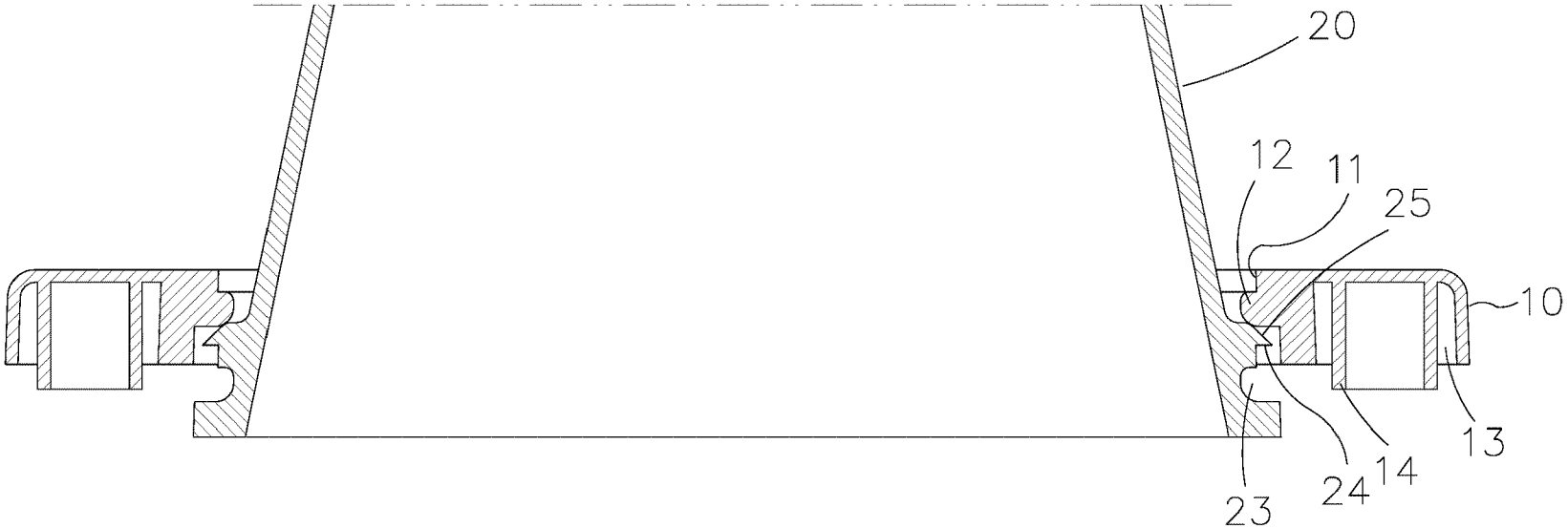
FIG. 4 is a schematic view showing a partial structural relation when being sleeved and assembled according to one preferred embodiment of the present invention.
Figure 5:
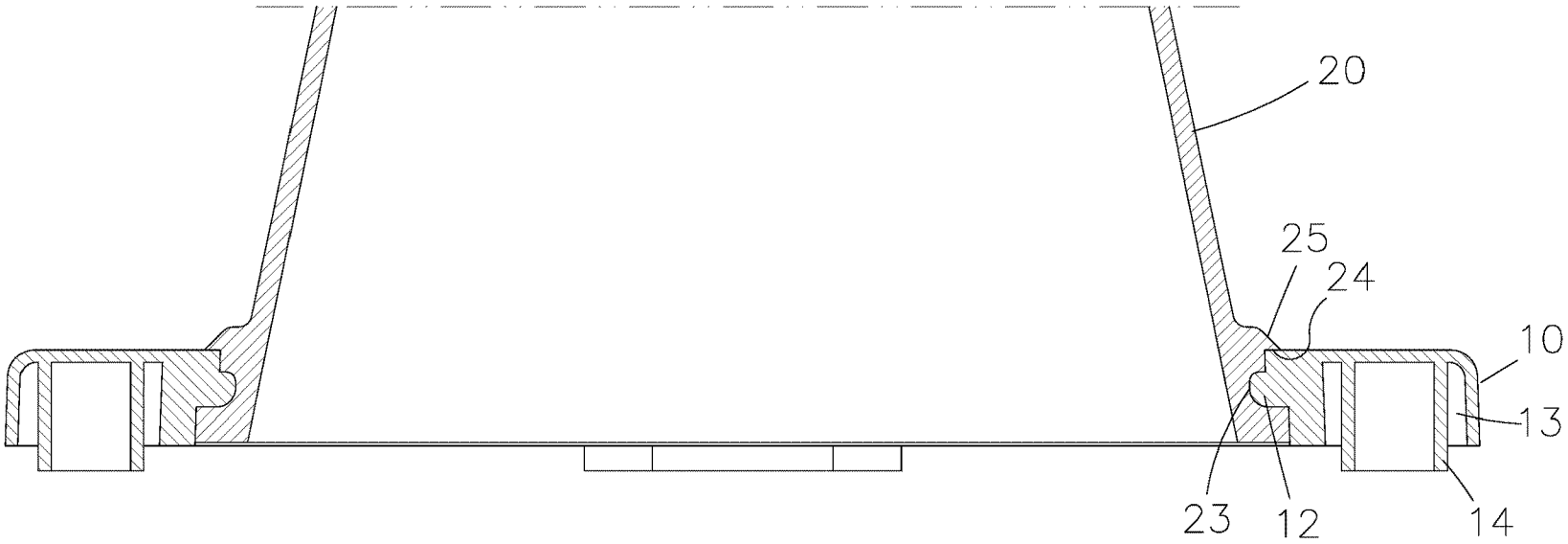
FIG. 5 is a schematic view showing a partial structural relation after being sleeved and assembled according to one preferred embodiment of the present invention.

Referring from FIG. 1 to FIG. 5, which disclose one preferred embodiment of the present invention; as shown in figures, the present invention provides a novel structural design for a traffic cone, in which a base (10) and a cone member (20) of a traffic cone are separately manufactured then assembled with each other, and a sleeve means is adopted for combing the base (10) and the cone member (20), thereby structuring a fully-established assembled traffic cone.

The base (10) is made of a material having poorer fluidity or a regenerated material, however a material with better fluidity can also be adopted if the production cost is not an issue to be concerned; the base (10) is formed as a rectangular plate-like member, and the center thereof is formed with a combination hole (11) having a predetermined dimension, the inner diameter of the combination hole (11) is matched with the outer diameter of a combination ring part (22) formed at a foundation portion of the cone member (20), the inner periphery of the combination hole (11) is formed with a convex mounting ring (12), and the bottom end of the base (10) is formed with a recessed slot (13) having a predetermined depth, preset amount of protruding members (14) are formed at predetermined locations thereby allowing the placing stability of the traffic cone to be enhanced through the installation of the protruding members (14), and an effect of providing a proper partition is achieved when traffic cones are stacked; moreover, with the different weight ratio specification of the base (10), the depth of the recessed slot (13) can be coordinately altered, in other words when the weight ratio of the base (10) is required to be greater, the depth of the recessed slot (13) would be shallower, so that the thickness of the base (10) is thicker, thereby allowing the manufacturing and assembling of the traffic cone to satisfy various specification requirements.

The cone member (20) is made of a light reflecting material having better fluidity, and formed with different heights with respect to different specification requirements, and the cone member (20) is formed as a conical-like member having a wider bottom and narrower top, and the top end thereof is formed with a penetrated hole (21) which can be inserted with a warning lamp (not shown in figures) whenever necessary, the foundation portion defined at the bottom end of the cone member (20) is formed with the above-mentioned combination ring part (22) which is in an radially expanding status, the outer edge of the combination ring part (22) is annularly formed with an annular mounting slot (23) for allowing the convex mounting ring (12) at the inner periphery of the combination hole (11) of the base (10) to be mounted therein for achieving a latching and positioning effect, the outer edge of the combination ring part (22) at the top end of the annular mounting slot (23) is formed with a decoration mounting ring (24) having a guiding surface (25), the diameter of the decoration mounting ring (24) is slightly larger than that of the combination hole (11) of the base (10), so when the convex mounting ring (12) of the base (10) is mounted in the annular mounting slot (23) of the combination ring part (22) of the cone member (20) for the purpose of latching and positioning, the decoration mounting ring (24) can be served to cover the edge of the combination hole (11) of the base (10).

Accordingly, by separately manufacturing the base (10) and the cone member (20), and the annular mounting slot (23) of the combination ring part (22) of the cone member (20) is arranged corresponding to the convex mounting ring (12) of the combination hole (11) at the center of the base (10), when the traffic cone is processed with an assembling and forming operation, the base (10) is sleeved in from the top end of the cone member (20) and downwardly moved to the combination ring part (22) at the foundation portion of the cone member (20), meanwhile the convex mounting ring (12) at the inner periphery of the combination hole (11) of the base (10) is enabled to be smoothly latched in the annular mounting slot (23) of the combination ring part (22) by being moved along the guiding surface (25) at the top edge of the decoration mounting ring (24), so that a stably mounting and combing effect can be provided, and the assembly of the traffic cone can be effectively finished; the decoration mounting ring (24) can be served to cover the edge of the combination hole (11) of the base (10) for providing a better appearance after the cone member (20) and the base (10) are sleeved with each other, and the cone member (20) and the base (10) with different specifications can be matched for providing various combinations; as such, the manufacturer can separately manufacture the cone member (20) and the base (10) with various specifications and store for future use, when a custom-made order is received, the base (10) and the cone member (20) with the required specifications can be selected for assembly, so the manufacturing for the traffic cone with the required specifications can be finished within the shortest time possible, thus comparing the conventional operating model of receiving orders then starting the manufacturing, the present invention has the economic benefits of shortening the manufacturing time and lowering production cost.

Moreover, the base (10) and the cone member (20) with different specifications require different molds, but the base (10) and the cone member (20) are able to provide various combinations, thus the amount of required molds is far less than the molds for the conventional injection-molded traffic cone in which a specification requiring a certain mold; furthermore, the volume of the required mold is relatively small, so the expenditure for fabricating molds can be greatly reduced, and with the base (10) and the cone member (20) being separately manufactured then assembled for formation, there would be less wasted products; accordingly, the present invention is novel and more practical in use comparing to prior art.

Based on what has been disclosed above, the assembled traffic cone provided by the present invention has following advantages: with the novel structural design of separately manufacturing the cone member and the base, the assembly of the traffic cone can save the material cost and the mold fabrication expenditure, and the specification requirements listed in the order can be satisfied by rapidly and efficiently assembling the cone member and the base which have already been manufactured and stored for future use, so problems and disadvantages existed in the conventional traffic cone can be solved, meanwhile the structural stability of the assembly and the whole appearance can also be enhanced and maintained; accordingly, the structural improvement of assembled traffic cone provided by the present invention is novel and more practical is use comparing to the conventional traffic cone.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A structural improvement of assembled traffic cone, in which a base and a cone member being separately manufactured then assembled afterward, wherein:

the base is formed as a rectangular plate-like member, the center thereof is formed with a combination hole having a predetermined dimension, an inner diameter of the combination hole is matched with an outer diameter of a combination ring part formed at a foundation portion defined at a bottom end of the cone member, and an inner periphery of the combination hole is formed with a convex mounting ring;

the cone member is formed as a conical-like member having a wider bottom and narrower top, the foundation portion is formed with the combination ring part which is in an radially expanding status, the outer edge of the combination ring part is annularly formed with an annular mounting slot, the annular mounting slot of the combination ring part allows the convex mounting ring at the inner periphery of the combination hole of the base to be mounted for combination, the outer edge of the combination ring part at the top end of the annular mounting slot is formed with a decoration mounting ring having a diameter slightly larger than the diameter of the combination hole of the base, so when the base and the cone member are assembled, the decoration mounting ring is able to cover an edge of the combination hole of the base;

accordingly, the assembly of the base and the cone member which are separately manufactured is able to form the assembled traffic cone.

2. The structural improvement of assembled traffic cone as claimed in claim 1, wherein a guiding surface is formed at the top edge of the decoration mounting ring of the combination ring part of the cone member.

3. The structural improvement of assembled traffic cone as claimed in claim 1, wherein the bottom end of the base is formed with a recessed slot having a predetermined depth, preset amount of protruding members are formed at predetermined locations, and the depth of the recessed slot is altered with respect to the different weight ratio specification of the base.

4. The structural improvement of assembled traffic cone as claimed in claim 1, wherein the cone member is made of a material having better fluidity, and the base is made of a material having poorer fluidity or a material having better fluidity.

* * * * *